US011813850B2

(12) United States Patent
Oda

(10) Patent No.: US 11,813,850 B2
(45) Date of Patent: Nov. 14, 2023

(54) PRINTING APPARATUS AND PRINTING SYSTEM

(71) Applicant: SEIKO EPSON CORPORATION, Tokyo (JP)

(72) Inventor: Koji Oda, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/452,081

(22) Filed: Oct. 25, 2021

(65) Prior Publication Data

US 2022/0126604 A1 Apr. 28, 2022

(30) Foreign Application Priority Data

Oct. 27, 2020 (JP) ..... 2020-179517

(51) Int. Cl.
*B41J 11/00* (2006.01)
*B41J 11/58* (2006.01)

(52) U.S. Cl.
CPC ..... *B41J 11/0095* (2013.01); *B41J 11/58* (2013.01)

(58) Field of Classification Search
CPC ..... B41J 13/106; B41J 11/0095; B41J 11/42; B41J 13/103; B41J 29/38; B41J 29/393; B65H 2801/27; B65H 2511/51
See application file for complete search history.

(56) References Cited

U.S. PATENT DOCUMENTS

2020/0062529 A1* 2/2020 Tsuji ..... B65H 43/06
2020/0290375 A1* 9/2020 Yamashita ..... B41J 29/023

FOREIGN PATENT DOCUMENTS

JP 2004-299811 A 10/2004

* cited by examiner

*Primary Examiner* — Jannelle M Lebron

(74) *Attorney, Agent, or Firm* — WORKMAN NYDEGGER

(57) ABSTRACT

A printing apparatus includes: a recording section that performs recording on a medium; a discharge tray on which the medium subjected to recording by the recording section is loaded; a detector that detects the medium loaded on the discharge tray; and an attachment section to which a sub-tray is attached, in which the detector is located at a first position and detects the medium loaded on the discharge tray in a state in which the sub-tray is not attached, is located at a second position and detects the medium in a state in which the sub-tray is attached, and moves from the first position to the second position in accordance with the sub-tray being attached to the attachment section.

19 Claims, 10 Drawing Sheets

PRINTING APPARATUS AND PRINTING SYSTEM

The present application is based on, and claims priority from JP Application Serial Number 2020-179517, filed Oct. 27, 2020, the disclosure of which is hereby incorporated by reference herein in its entirety.

BACKGROUND

1. Technical Field

The present disclosure relates to a printing apparatus and a printing system.

2. Related Art

Image forming apparatuses, which are examples of a printing apparatus, for performing printing on a sheet, which is an example of a medium, as in JP-A-2004-299811 are known. An image forming apparatus includes an image forming section, which is an example of a recording section, for performing recording on a sheet, a loading tray, which is an example of a discharge tray, for loading a sheet subjected to recording by the image forming section, and a full-load detector, which is an example of a detector. The full-load detector is located in a detection region, in which a sheet is detected, and detects that the amount of sheets loaded on the loading tray is equal to or more than a fixed amount.

A sheet post-processing device, which is an example of an optional device, is attachable to the image forming apparatus. When attached to the image forming apparatus, the sheet post-processing device pushes the full-load detector and moves the full-load detector located in the detection region to a non-detection region in which no detection of a sheet is performed.

When, for example, an optional device that allows a medium to be loaded even after attachment is attached to a printing apparatus, attachment of the optional device may change a maximum loading amount of media. However, when a detector which detects full load in a state in which the optional device is attached and a detector which detects full load in a state in which the optional device is not attached are both provided, costs increase compared with an instance in which a single detector is provided.

SUMMARY

A printing apparatus to address the aforementioned problem includes: a recording section that performs recording on a medium; a discharge tray on which the medium subjected to recording by the recording section is loaded; a detector configured to detect the medium loaded on the discharge tray; and an attachment section to which an optional device is attached, in which the detector is located at a first position in a state in which the optional device is not attached, and the detector moves from the first position to a second position in accordance with the optional device being attached to the attachment section when the optional device is being attached.

A printing system to address the aforementioned problem includes: the printing apparatus having the aforementioned configuration; and an optional device attached to the printing apparatus.

DESCRIPTION OF EXEMPLARY EMBODIMENTS

First Embodiment

Figure 1:
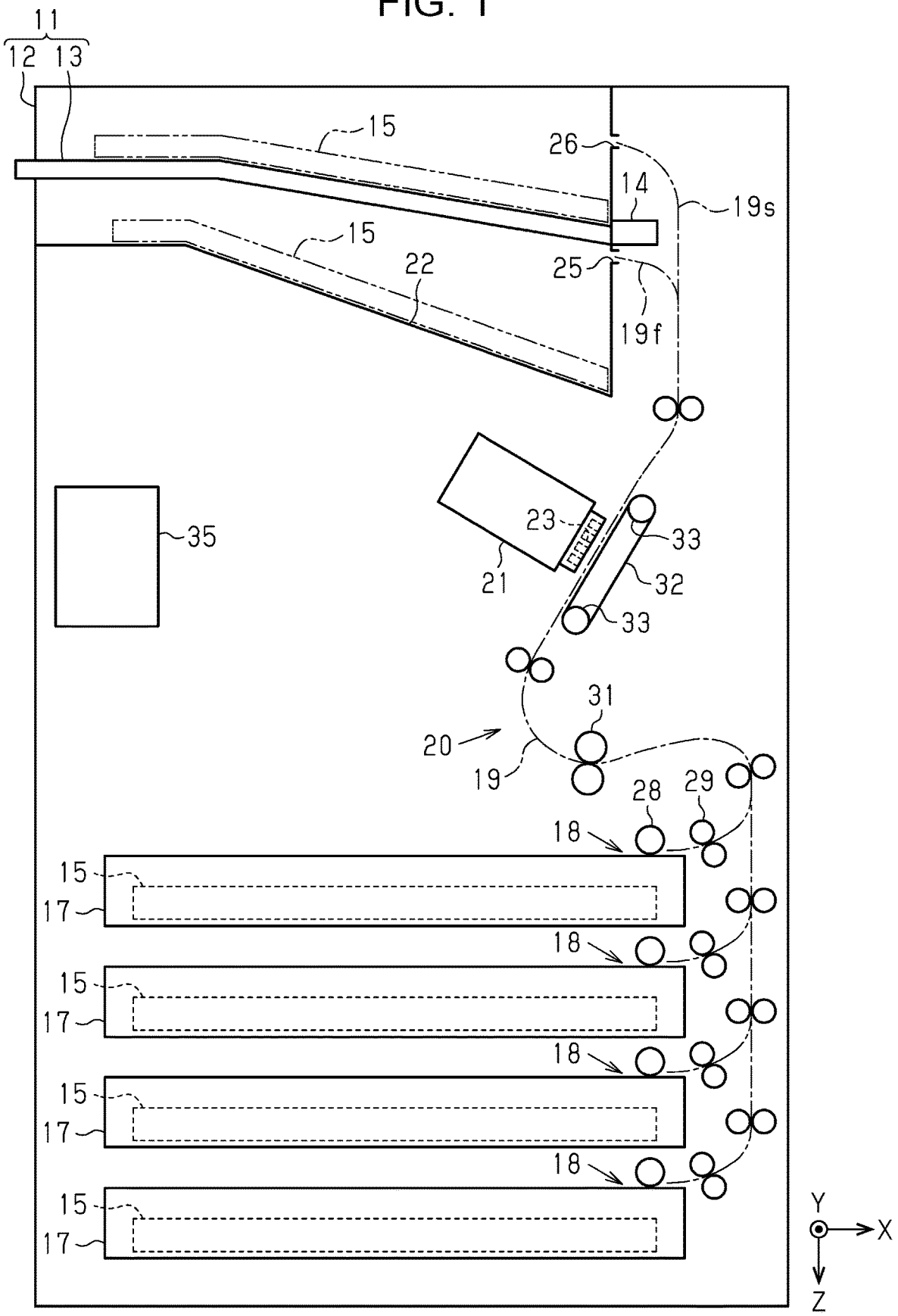
FIG. 1 is a schematic view illustrating a printing apparatus and a printing system of a first embodiment.

A first embodiment of a printing apparatus and a printing system will be described below with reference to the drawings. The printing apparatus of the present embodiment is, for example, an ink jet printer that ejects ink, which is an example of a liquid, onto a medium, such as a sheet, to perform printing.

In the drawings, on the assumption that a printing system 11 is installed on a horizontal surface, the direction of gravity is indicated by the Z-axis, and directions extending horizontally are indicated by the X-axis and the Y-axis. The X-axis, the Y-axis, and the Z-axis are orthogonal to each other. In the following description, a direction parallel to the Y-axis is also referred to as a depth direction Y, and a direction parallel to the Z-axis is also referred to as a vertical direction Z.

As illustrated in FIG. 1, the printing system 11 includes a printing apparatus 12 and a sub-tray 13, which is an example of an optional device attached to the printing apparatus 12. The printing apparatus 12 includes an attachment section 14 to which the sub-tray 13 is attachable. The sub-tray 13 is detachably attached to the attachment section 14.

The printing apparatus 12 may include a medium-accommodating section 17 that is able to accommodate a medium 15, a feeding section 18 that feeds the medium 15, and a transporting section 20 that transports the medium 15 on a transporting path 19 indicated by the one-dot chain line in the figure. The printing apparatus 12 includes a recording section 21 that performs printing on the medium 15 and a discharge tray 22 on which the medium 15 subjected to recording by the recording section 21 is loaded. The recording section 21 of the present embodiment ejects liquid through nozzles 23 to perform recording.

The transporting path 19 may include a first branch path 19*f* and a second branch path 19*s*. The first branch path 19*f* leads to a first discharge port 25 from which the medium 15 is discharged to the discharge tray 22. The second branch path 19*s* leads to a second discharge port 26 located higher than the first discharge port 25.

The medium-accommodating section 17 is able to accommodate a plurality of media 15 in a stacked manner. The printing apparatus 12 may include a plurality of medium-accommodating sections 17 and feeding sections 18 in the same number as the medium-accommodating sections 17. The feeding section 18 may include a feeding roller 28 that feeds the medium 15 accommodated in the medium-accommodating section 17 and a separating section 29 that separates media 15 one by one. The feeding section 18 feeds the medium 15 accommodated in the medium-accommodating section 17 to the transporting path 19.

The transporting section 20 may include a transporting roller 31, a transporting belt 32 which is endless, and a plurality of pulleys 33 around which the transporting belt 32 is wound. The transporting section 20 may include a plurality of transporting rollers 31. The transporting rollers 31 transport the medium 15 by rotating in a state of holding the medium 15 therebetween. The transporting belt 32 transports the medium 15 by circulating around the pulleys 33 in a state of supporting the medium 15 through, for example, electrostatic adsorption.

The printing apparatus 12 includes a control section 35 that controls recording performed by the recording section 21. The control section 35 may control various operations of the printing apparatus 12. The control section 35 can be constituted as a circuit including α: one or more processors that execute various types of processing in accordance with a computer program; β: one or more dedicated hardware circuits, such as an application specific integrated circuit, which execute at least some of the various types of processing; or γ: a combination thereof. A processor includes a CPU and memory such as RAM or ROM, and the memory stores program code or commands which cause the CPU to execute processing. The memory, that is, a computer-readable medium, may be any readable medium accessible by using a general-purpose or dedicated computer.

Figure 2:
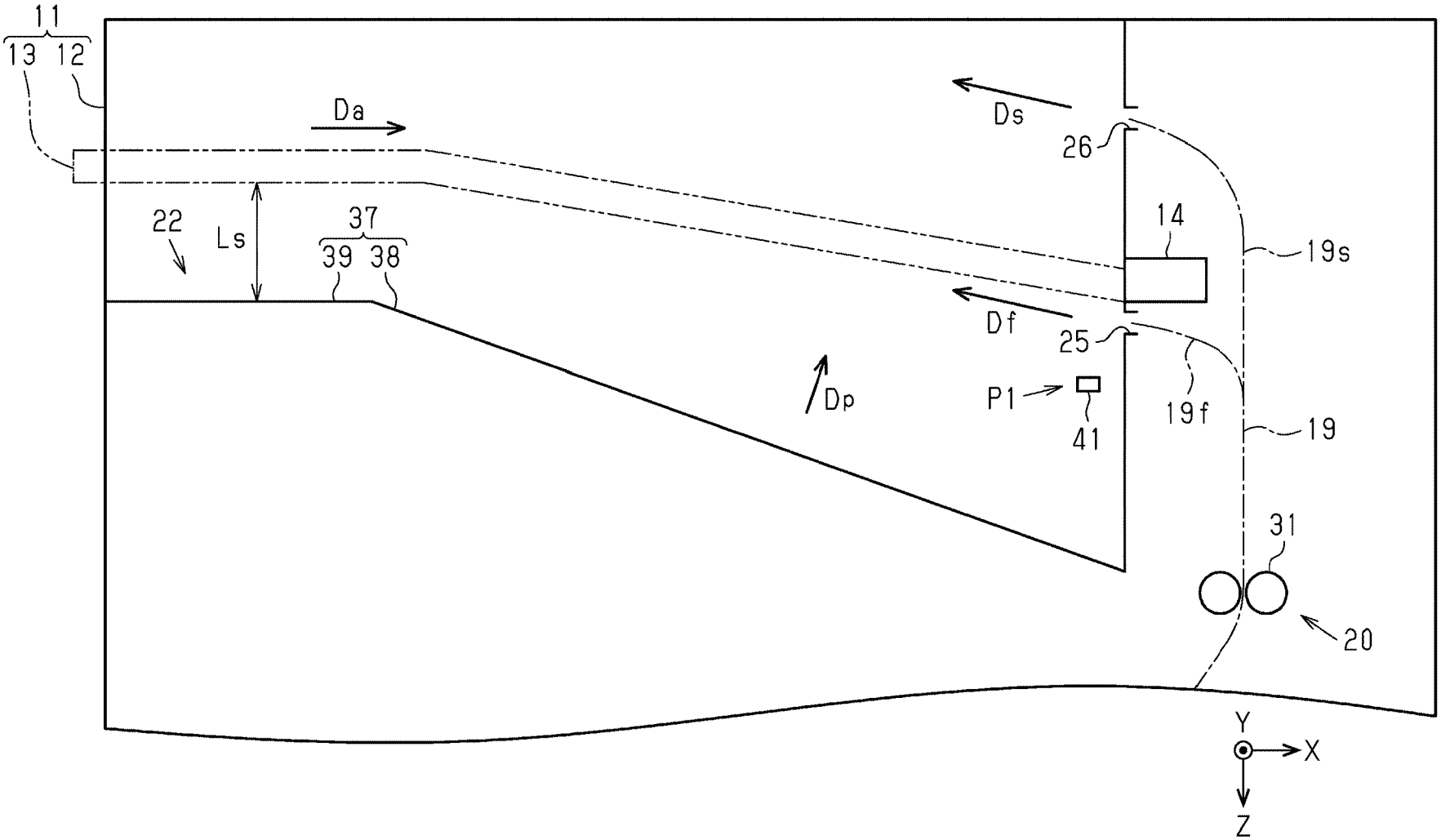
FIG. 2 is a schematic view of a portion of the printing apparatus.

As illustrated in FIG. 2, the attachment section 14 may be located between the first discharge port 25 and the second discharge port 26 in the vertical direction Z. The sub-tray 13 is inserted into the attachment section 14 in an attaching direction Da and thereby attached to the attachment section 14. The attaching direction Da of the present embodiment extends along the X-axis.

The sub-tray 13 attached to the attachment section 14 is located above the discharge tray 22. The sub-tray 13 is attached at a position higher than the first discharge port 25 so as to be apart from the discharge tray 22. Accordingly, the medium 15 discharged from the first discharge port 25 is loaded on the discharge tray 22 also in a state in which the sub-tray 13 is attached. The medium 15 discharged from the second discharge port 26 in the state in which the sub-tray 13 is attached is loaded on the sub-tray 13.

The transporting section 20 discharges the medium 15 from the first discharge port 25 in a first discharging direction Df. The transporting section 20 discharges the medium 15 from the second discharge port 26 in a second discharging direction Ds. The first discharging direction Df and the second discharging direction Ds may be the same or different.

The discharge tray 22 includes a loading surface 37 on which the medium 15 is loaded. Media 15 are piled in a loading direction Dp perpendicular to the loading surface 37. The loading direction Dp includes a component of the vertical direction Z. The loading surface 37 may have an inclined surface 38 inclined with respect to the horizontal surface and a planar surface 39 inclined more gently than the inclined surface 38. The planar surface 39 is located downstream of the inclined surface 38 in the first discharging direction Df and is continuous to the downstream edge of the inclined surface 38. The downstream edge of the inclined surface 38 is located higher than the upstream edge of the inclined surface 38 in the first discharging direction Df.

A distance between the sub-tray 13 attached to the attachment section 14 and the discharge tray 22 in the loading direction Dp is reduced from an upstream portion toward a downstream portion in the first discharging direction Df. In the present embodiment, a distance between the sub-tray 13 and the planar surface 39 in the loading direction Dp is a minimum distance Ls between the sub-tray 13 attached to the attachment section 14 and the discharge tray 22. The minimum distance Ls is a minimum distance between the sub-tray 13 attached to the attachment section 14 and the loading surface 37 in a direction perpendicular to the loading surface 37.

The printing apparatus 12 includes a detector 41 that detects the medium 15 loaded on the discharge tray 22. The detector 41 is located at a first position P1 in a state in which the sub-tray 13 is not attached. The first position P1 is lower than the position of the first discharge port 25.

Figure 3:
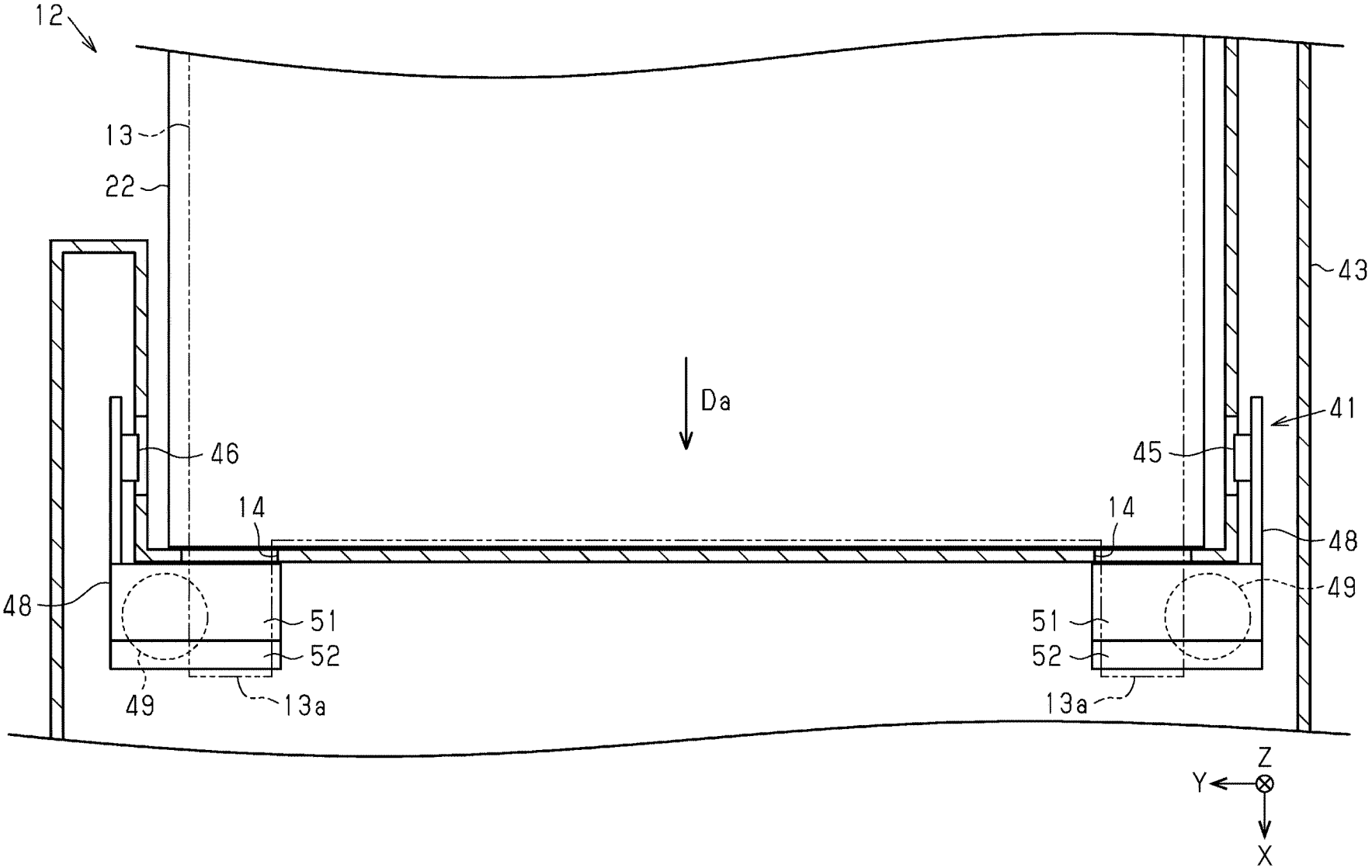
FIG. 3 is a sectional view of a portion of the printing apparatus.

As illustrated in FIG. 3, the printing apparatus 12 includes a housing 43. The attachment section 14 of the present embodiment includes a hole which is open in the housing 43. The printing apparatus 12 of the present embodiment includes two attachment sections 14 arranged apart from each other in the depth direction Y.

The sub-tray 13 of the present embodiment includes two first protrusions 13*a* protruding from the front edge in the attaching direction Da. The two first protrusions 13*a* are arranged apart from each other in the depth direction Y. When each of the two first protrusions 13*a* is inserted into a corresponding one of the attachment sections 14 in the attaching direction Da, the sub-tray 13 is attached to the attachment section 14.

The detector 41 of the present embodiment is an optical sensor including a radiating section 45 that radiates light and a light-receiving section 46 that receives the light radiated from the radiating section 45. The radiating section 45 and the light-receiving section 46 may be provided at the same position in the attaching direction Da, the vertical direction Z, the loading direction Dp, the first discharging direction Df, and the second discharging direction Ds so as to be arranged with a gap therebetween in the depth direction Y, the gap being greater than the medium 15.

The printing apparatus 12 may include a holding member 48 that holds the detector 41 and a spring 49 that pushes the holding member 48 upward. The printing apparatus 12 of the present embodiment includes two holding members 48 arranged apart from each other in the depth direction Y. One of the holding members 48 holds the radiating member 45, and the other holding member 48 holds the light-receiving section 46.

The two holding members 48 are provided so as to be linearly symmetrical with respect to a virtual line (not illustrated) parallel to the X-axis. In the following description, one of the holding members 48 will be described, the same constituents of the holding members 48 will be given the same reference numerals, and description for the other holding member 48 will be thereby omitted.

The holding member 48 has a guiding surface 51 and a retaining surface 52. At least a portion of the guiding surface 51 and the retaining surface 52 is located in the attachment section 14 in the state in which the sub-tray 13 is not attached. The guiding surface 51 and the retaining surface 52 come into contact with the first protrusion 13*a* when the sub-tray 13 is attached to the attachment section 14.

Figure 4:
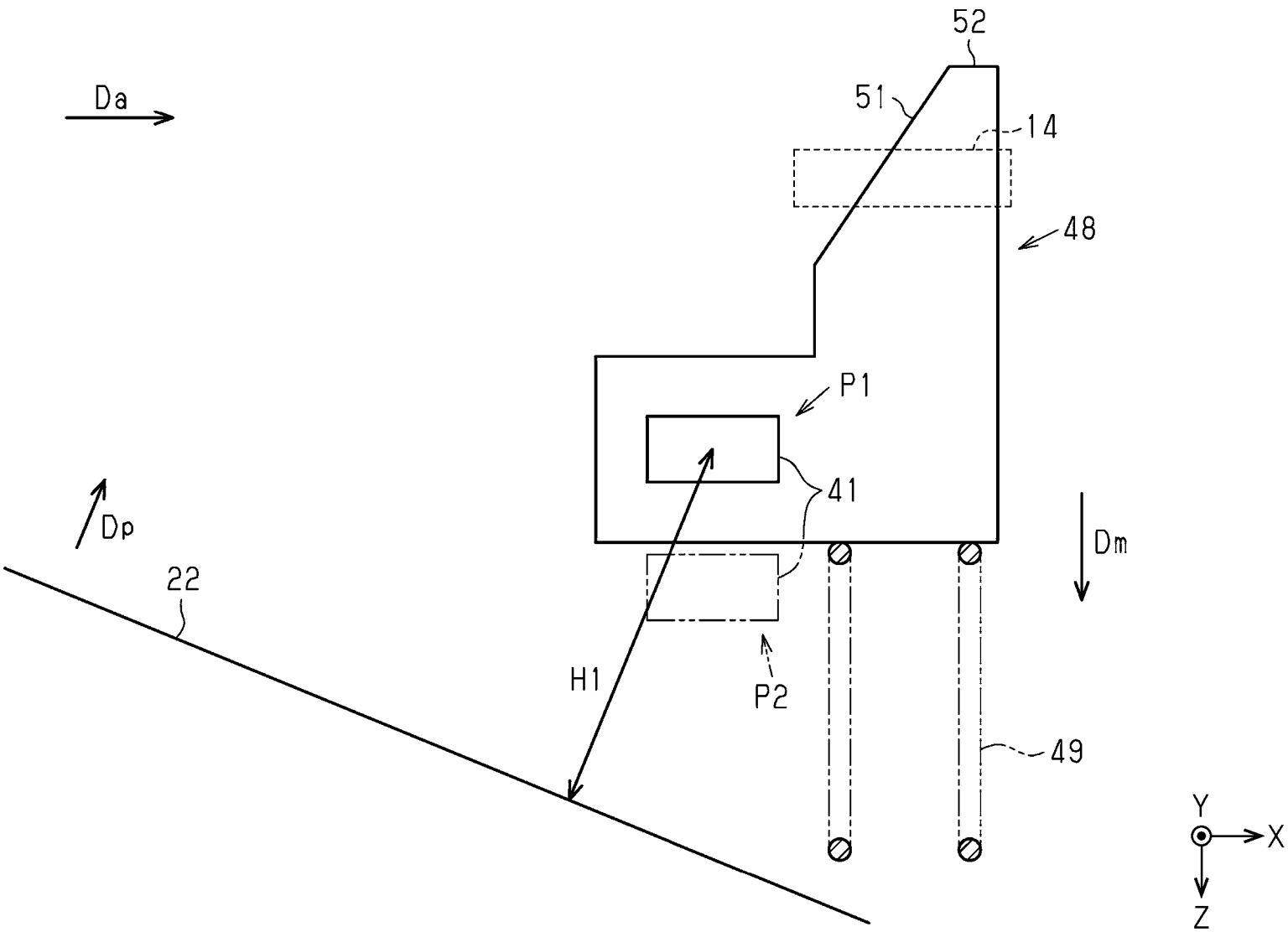
FIG. 4 is a schematic view illustrating a detector in a non-attached state of a sub-tray.

As illustrated in FIG. 4, the detector 41 located at the first position P1 detects media 15 with a first loading amount H1, which are loaded on the discharge tray 22. The first loading amount H1 corresponds to a thickness of the loaded media 15 and is equal to a distance from the discharge tray 22 to the detector 41 located at the first position P1 in the loading direction Dp.

Figure 5:
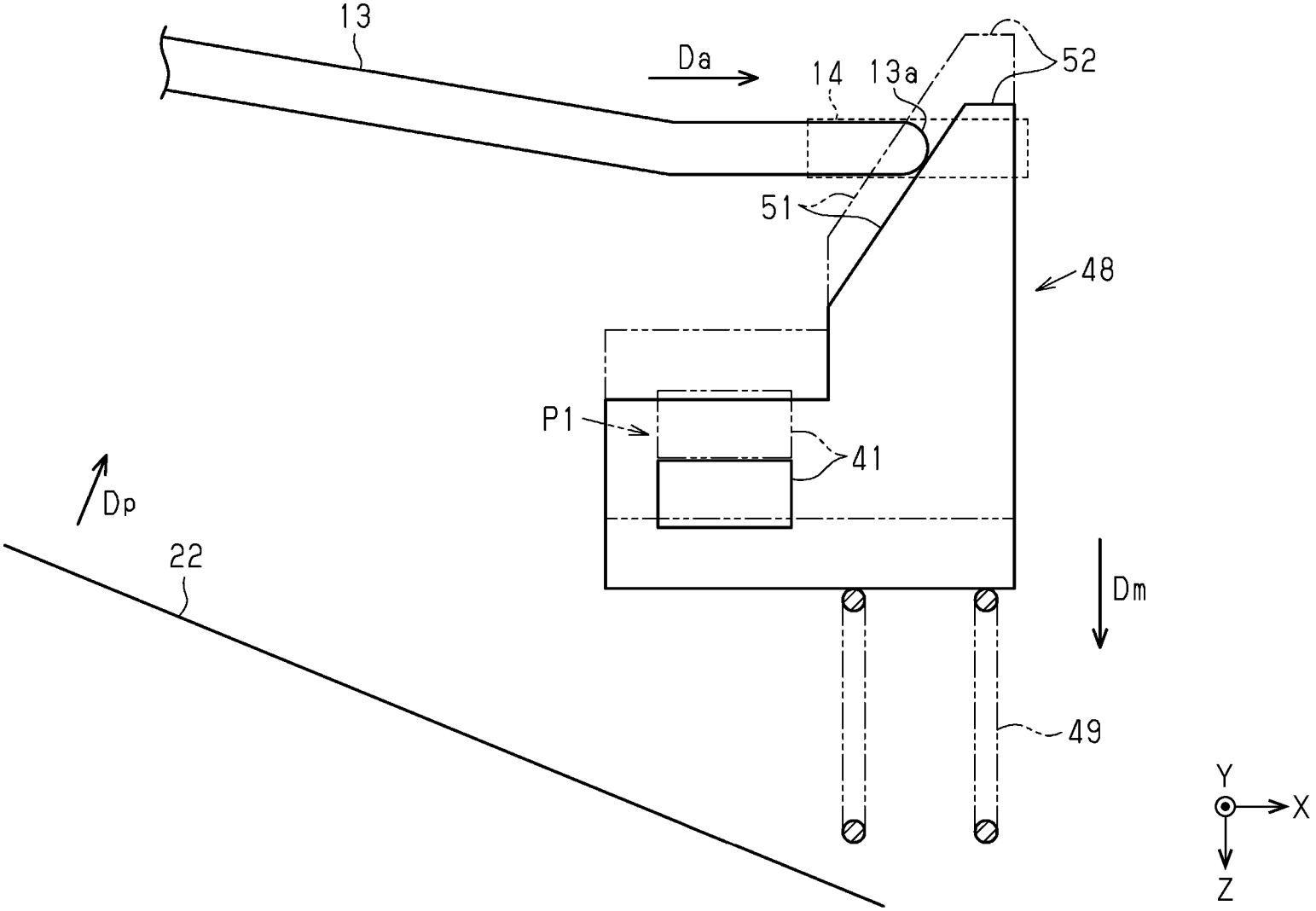
FIG. 5 is a schematic view illustrating the detector when the sub-tray is being attached to an attachment section.

As illustrated in FIG. 5, when the first protrusion 13*a* pushes the guiding surface 51 in the attaching direction Da, the holding member 48 moves in a moving direction Dm. The moving direction Dm of the present embodiment extends along the Z-axis. The holing member 48 pushed by the first protrusion 13*a* moves downward. At this time, the detector 41 moves from the first position P1 to a second position P2, which is located lower than the first position P1.

The printing apparatus 12 may include a guiding section (not illustrated) which guides the holding member 48 in the moving direction Dm. In this instance, the spring 49 is pushed by the holding member 48 and thereby contracts. Accordingly, when the guiding surface 51 and the spring 49 are aligned in the moving direction Dm, the holding member 48 is able to stably move.

Figure 6:
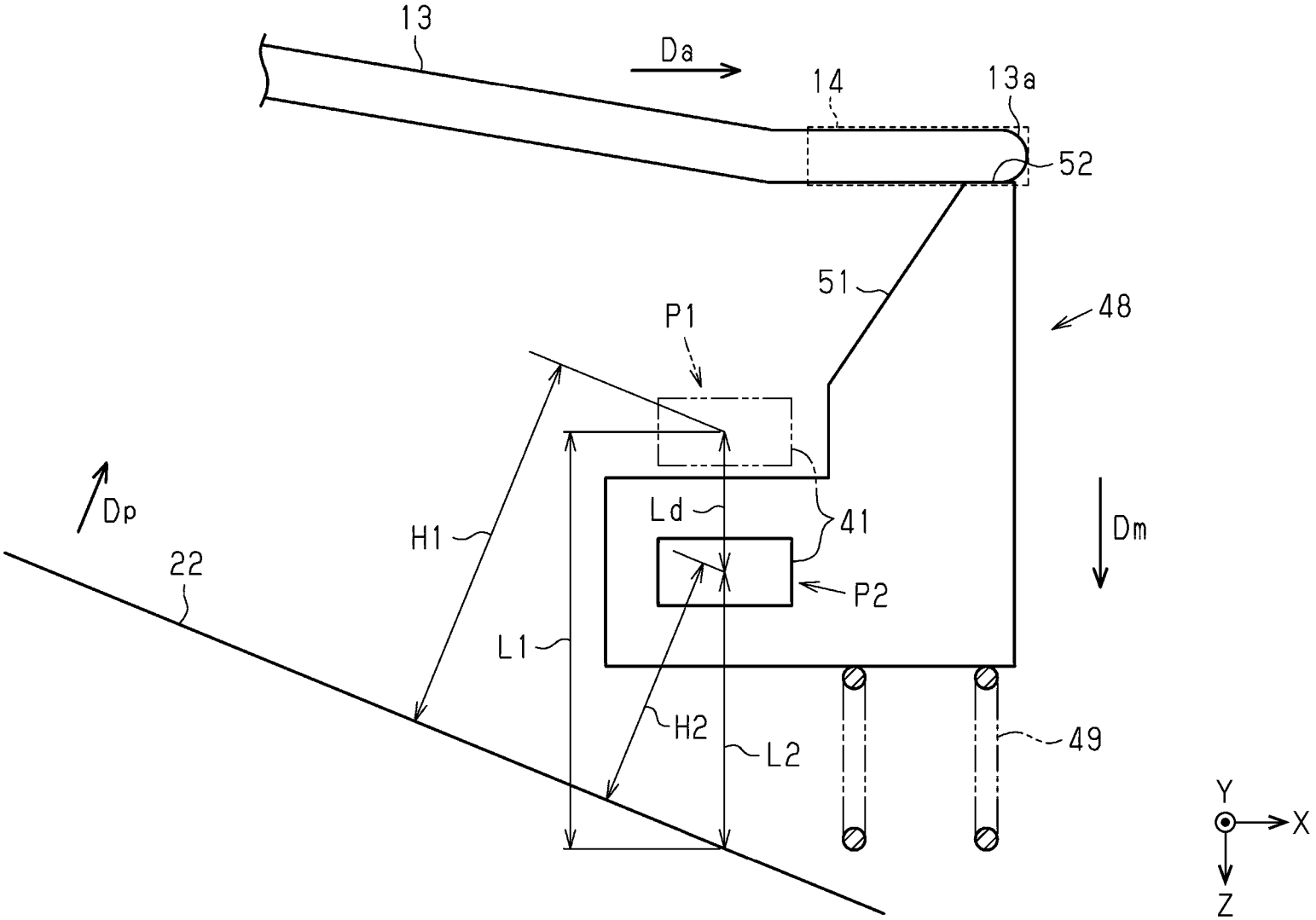
FIG. 6 is a schematic view illustrating the detector in an attached state of the sub-tray.

As illustrated in FIG. 6, the retaining surface 52 is aligned with the guiding surface 51 in the attaching direction Da and located on a side further than the guiding surface 51 in the attaching direction Da. The retaining surface 52 extends along a plane parallel to the attaching direction Da. Accordingly, when the front end of the first protrusion 13*a* passes over the guiding surface 51, the sub-tray 13 moves in the attaching direction Da while retaining a height of the holding member 48. At this time, the detector 41 is retained at the second position P2.

The detector 41 is held by the holding member 48 and moves together with the holding member 48. That is, the detector 41 moves from the first position P1 to the second position P2 in accordance with the sub-tray 13 being attached to the attachment section 14. The second position P2 of the present embodiment is lower than the first position P1. The detector 41 is located at the second position P2 in the state in which the sub-tray 13 is attached.

The detector 41 located at the second position P2 detects media 15 with a second loading amount H2, which are loaded on the discharge tray 22. The second loading amount H2 corresponds to a thickness of the loaded media 15 and is equal to a distance from the discharge tray 22 to the detector 41 located at the second position P2 in the loading direction Dp.

A first distance L1 between the first position P1 and the loading surface 37 is longer than a second distance L2 between the second position P2 and the loading surface 37. The first distance L1 is a distance between the first position P1 and the loading surface 37 in the vertical direction Z. The second distance L2 is a distance between the second position P2 and the loading surface 37 in the vertical direction Z.

The second distance L2 is shorter than the first distance L1. The second distance L2 may be shorter than the minimum distance Ls. That is, the second distance L2 between the second position P2 and the loading surface 37 in the vertical direction Z may be shorter than the minimum distance Ls between the sub-tray 13 attached to the attachment section 14 and the loading surface 37 in the direction perpendicular to the loading surface 37.

The amount by which the detector 41 moves from the first position P1 to the second position P2 may be larger than a difference between a first maximum loading amount in the state in which the sub-tray 13 is not attached to the attachment section 14 and a second maximum loading amount in the state in which the sub-tray 13 is attached. The amount by which the detector 41 moves from the first position P1 to the second position P2 is equal to a difference distance Ld which corresponds to a difference between the first distance L1 and the second distance L2. The first maximum loading amount corresponds to a distance from the discharge tray 22 to the first discharge port 25 in the loading direction Dp. The second maximum loading amount corresponds to the minimum distance Ls.

Operation of the present embodiment will be described.

Non-Attached State

As illustrated in FIG. 4, the detector 41 is located at the first position P1 in the state in which the sub-tray 13 is not attached. The control section 35 selects the first discharge port 25 as a discharge port from which the medium 15 is discharged. The medium 15 is discharged from the first discharge port 25 onto the discharge tray 22. Media 15 discharged from the first discharge port 25 are sequentially loaded on the discharge tray 22.

When the detector 41 located at the first position P1 detects the media 15, the control section 35 determines that the state is a full-load state in which the media 15 with the first loading amount H1 are loaded on the discharge tray 22. When determining that the state is the full-load state, the control section 35 performs full-load processing. The full-load processing here indicates processing of stopping discharging a medium 15 from the first discharge port 25.

Attaching Process

As illustrated in FIG. 5, when attaching the sub-tray 13 to the attachment section 14, an operator moves the sub-tray 13 in the attaching direction Da in a state in which the sub-tray 13 is located higher than the discharge tray 22. The operator moves the sub-tray 13 in the attaching direction Da so as to insert the first protrusion 13*a* into the attachment section 14.

The first protrusion 13*a* moving in the attaching direction Da pushes the guiding surface 51 in the attaching direction Da. The edge of the guiding surface 51 on the downstream in the attaching direction Da is located higher than the edge on the upstream. Accordingly, when the sub-tray 13 is moved in the attaching direction Da, the holding member 48 moves downward, and the detector 41 also moves downward in accordance with the movement of the holding member 48. That is, the holding member 48 and the detector 41 move from the first position P1 to the second position P2 in accordance with the sub-tray 13 being attached to the attachment section 14. The amount by which the detector 41 moves in the vertical direction Z is proportional to the amount by which the first protrusion 13*a* moves while being in contact with the guiding surface 51.

As illustrated in FIG. 6, when passing over the guiding surface 51, the first protrusion 13*a* comes into contact with the retaining surface 52. The retaining surface 52 extends along a plane parallel to the attaching direction Da. The first protrusion 13*a* thus moves in the attaching direction Da while retaining the height position of the holding member 48. The first protrusion 13*a* restricts upward movement of the holding member 48 pushed by the spring 49. Attachment of the sub-tray 13 is finished in a state in which the first protrusion 13*a* presses the retaining surface 52.

Attached State

As illustrated in FIG. 6, the detector 41 is located at the second position P2 in the state in which the sub-tray 13 is attached. In the attached state of the sub-tray 13, the medium 15 discharged from the first discharge port 25 is loaded on the discharge tray 22, and the medium 15 discharged from the second discharge port 26 is loaded on the sub-tray 13.

The control section 35 selects the first discharge port 25 or the second discharge port 26 as a discharge port from which the medium 15 is discharged. The control section 35 may select the discharge port in accordance with a type of the medium 15, an orientation of the medium 15, a recording condition, or the like. Media 15 discharged from the first discharge port 25 are sequentially loaded on the discharge tray 22. Media 15 discharged from the second discharge port 26 are sequentially loaded on the sub-tray 13.

When the detector 41 located at the second position P2 detects the media 15, the control section 35 determines that the state is a full-load state in which the media 15 with the second loading amount H2 are loaded on the discharge tray 22. When determining that the state is the full-load state, the control section 35 may stop discharging a medium 15 from the first discharge port 25.

Detaching Process

As illustrated in FIG. 5, the operator detaches the sub-tray 13 from the attachment section 14 by moving the sub-tray 13 in a direction opposite to the attaching direction Da. When the first protrusion 13*a* leaves the retaining surface 52 and comes into contact with the guiding surface 51, the holding member 48 and the detector 41 are pushed by the spring 49 and thereby move upward.

Effects of the present embodiment will be described.

The detector 41 moves from the first position P1 to the second position P2 in accordance with attachment of the sub-tray 13. The first position P1 is a position for detecting the medium 15 in the state in which the sub-tray 13 is not attached. The second position P2 is a position for detecting the medium 15 in the state in which the sub-tray 13 is attached. Accordingly, a single detector 41 is able to detect the medium 15, enabling detection of the medium 15 according to the attached state or non-attached state of the sub-tray 13 while suppressing an increase in cost.

In an instance in which, for example, the sub-tray 13 is attached above the discharge tray 22 so as to be apart from the discharge tray 22, the number of media 15 which are able to be loaded on the discharge tray 22 decreases compared with an instance in which the sub-tray 13 is not attached. The sub-tray 13 thus causes the detector 41 located at the first position P1 to move to the second position P2 lower than the first position P1. That is, the detector 41 approaches the discharge tray 22 and is thereby able to detect the medium 15 also in the state in which the sub-tray 13 is attached.

The second distance L2 between the second position P2 and the loading surface 37 in the vertical direction Z is shorter than the minimum distance Ls between the sub-tray 13 and the loading surface 37 in the direction perpendicular to the loading surface 37. The minimum distance Ls between the sub-tray 13 and the loading surface 37 in the direction perpendicular to the loading surface 37 corresponds to the maximum loading amount by which media 15 are able to be loaded on the discharge tray 22 in the state in which the sub-tray 13 is attached. Accordingly, the detector 41 is able to detect a medium 15 before media 15 with the maximum loading amount are loaded and no more medium 15 is able to be loaded.

The amount by which the detector 41 moves from the first position P1 to the second position P2 is larger than the difference between the first maximum loading amount in the non-attached state of the sub-tray 13 and the second maximum loading amount in the attached state. The difference between the first maximum loading amount and the second maximum loading amount corresponds to a loading amount that decreases due to attachment of the sub-tray 13. That is, since the amount by which the detector 41 moves in response to attachment of the sub-tray 13 is larger than the loading amount that decreases due to attachment of the sub-tray 13, it is possible to make the second maximum loading amount larger than a loading amount of media 15 detected by the detector 41 at the second position P2, enabling a reduction in possible overloading. Moreover, even in a state in which the medium 15 is curved in a downstream portion in the first discharging direction Df, since the second maximum loading amount is larger than the second loading amount H2, while enabling the medium 15 to be curved in the downstream portion in the first discharging direction Df, it is possible to discharge the succeeding medium 15. It is therefore possible to suppress possible overloading or possible discharge failure caused when a medium 15 comes into contact with the preceding medium 15 which has been mounted on the loading surface 37.

In an instance in which, for example, a user detaches the detector 41 located at the first position P1 and attaches the detector 41 at the second position P2, a burden on the user increases. From this viewpoint, the detector 41 moves from the first position P1 to the second position P2 in accordance with attachment of the sub-tray 13. It is thus possible to suppress increase in the burden on the user.

Second Embodiment

Next, a second embodiment of the printing apparatus and the printing system will be described with reference to the drawings. Note that the second embodiment differs from the first embodiment in that a joint mechanism that joins the printing apparatus and a post-processing device is attached as an optional device and in that a second position is a position higher than a first position. Since the other points are substantially the same as those of the first embodiment, the same constituents will be given the same reference numerals, and redundant description will be thereby omitted.

Figure 7:
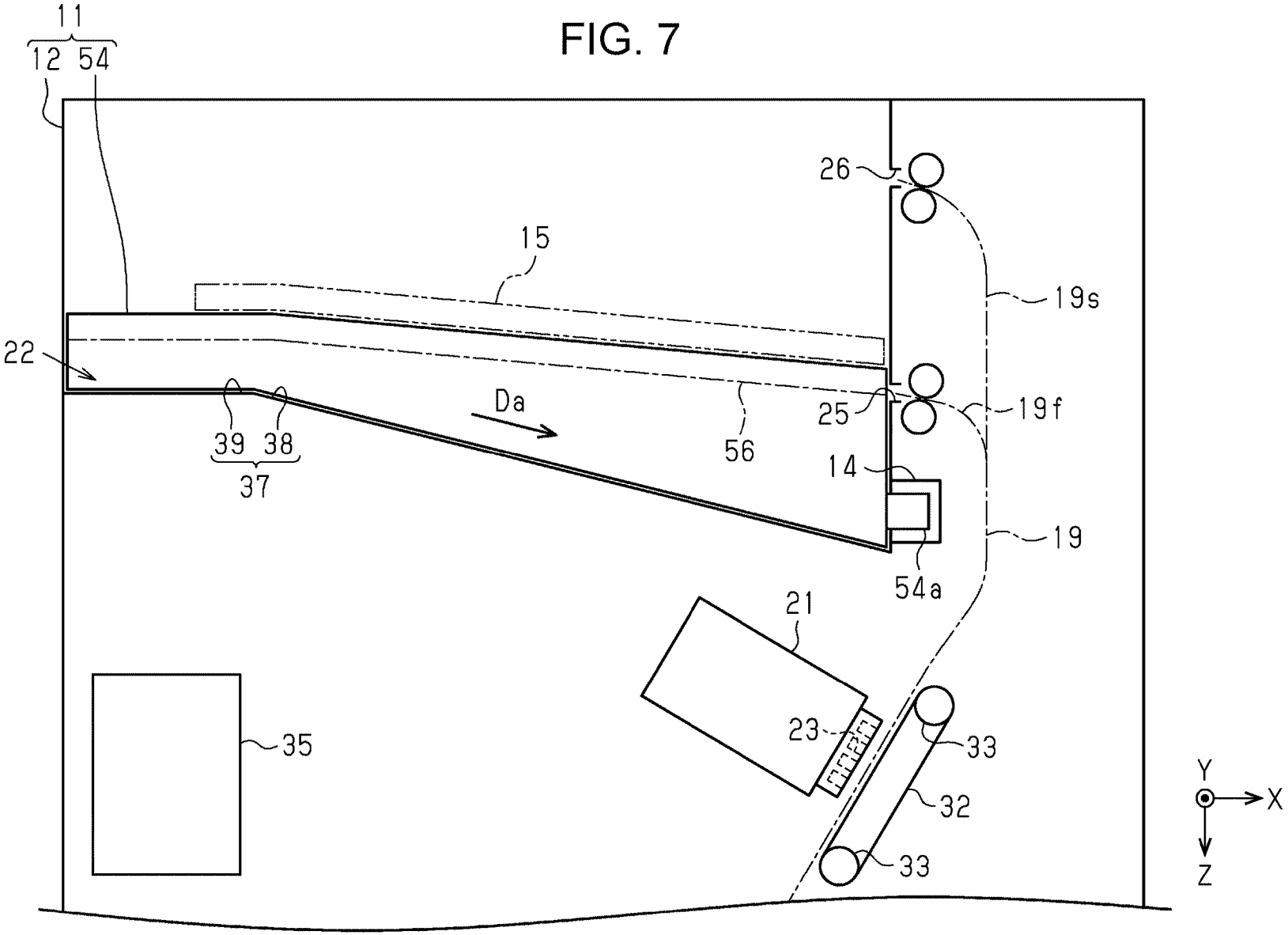
FIG. 7 is a schematic view illustrating a printing apparatus and a printing system of a second embodiment.

As illustrated in FIG. 7, the printing system 11 includes the printing apparatus 12 and a joint mechanism 54, which is an example of an optional device attached to the printing apparatus 12. The joint mechanism 54 is a member that joins the printing apparatus 12 and a post-processing device (not illustrated). The post-processing device is arranged so as to be adjacent to the printing apparatus 12 and performs post-processing for the medium 15 subjected to recording. Examples of the post-processing include staple processing for binding a plurality of media 15, punching processing, saddle stitching processing, and folding processing.

The joint mechanism 54 may include a second protrusion 54*a* protruding from the front edge in the attaching direction Da. The attaching direction Da of the present embodiment is a direction extending along the inclined surface 38. The joint mechanism 54 may include a plurality of second protrusions 54*a*. When the second protrusion 54*a* is inserted into the attachment section 14, the joint mechanism 54 is attached to the attachment section 14. The joint mechanism 54 may be detachably attached to the attachment section 14.

The joint mechanism 54 may be attached so as to be mounted on the discharge tray 22. At least a portion of the attached joint mechanism 54 may be located between the first discharge port 25 and the discharge tray 22.

The joint mechanism 54 may have a joining path 56 on which the medium 15 is able to be transported. In a state in which the joint mechanism 54 is attached, the upstream end of the joining path 56 is located at the first discharge port 25, and the joining path 56 leads to the first branch path 19*f*. The medium 15 passing through the first branch path 19*f* and discharged from the first discharge port 25 is thereby transported to the post-processing device through the joining path 56.

The joint mechanism 54 attached to the attachment section 14 is located lower than the second discharge port 26. The medium 15 discharged from the second discharge port 26 in the state in which the joint mechanism 54 is attached is loaded on the joint mechanism 54. In other words, the medium 15 subjected to recording by the recording section 21 is loaded on the joint mechanism 54.

Figure 8:
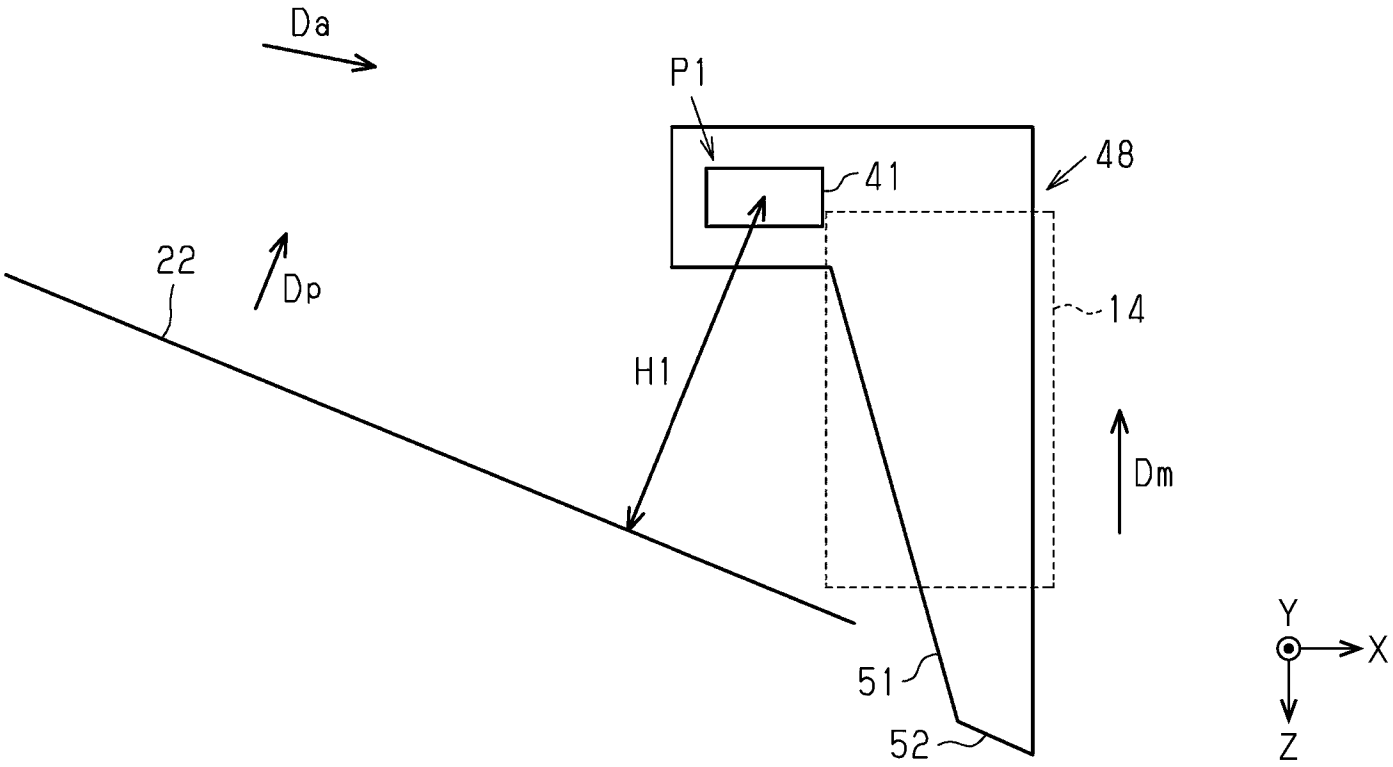
FIG. 8 is a schematic view illustrating a detector in a non-attached state of a joint mechanism.

As illustrated in FIG. 8, the guiding surface 51 of the present embodiment is a surface inclined with respect to the attaching direction Da. The guiding surface 51 extends along a plane inclined with respect to the horizontal surface, and the edge on the downstream in the attaching direction Da is located lower than the edge on the upstream. The detector 41 located at the first position P1 detects media 15 with the first loading amount H1, which are loaded on the discharge tray 22.

Figure 9:
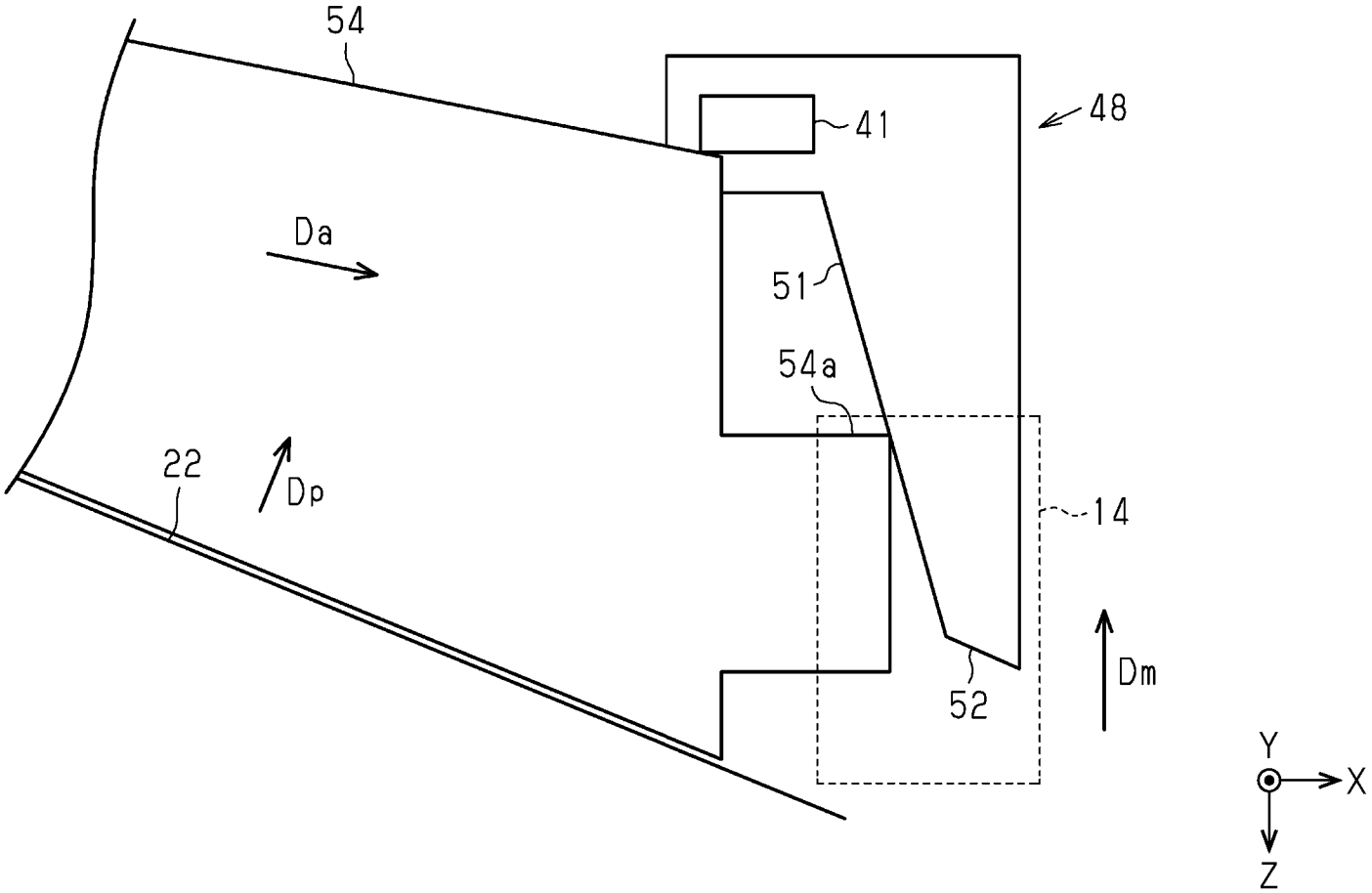
FIG. 9 is a schematic view illustrating the detector when the joint mechanism is being attached to an attachment section.

As illustrated in FIG. 9, when the second protrusion 54*a* pushes the guiding surface 51 in the attaching direction Da, the holding member 48 moves in the moving direction Dm. The moving direction Dm of the present embodiment is a direction extending along the Z-axis. The holding member 48 pushed by the second protrusion 54*a* moves upward. At this time, the detector 41 moves from the first position P1 to the second position P2, which is located higher than the first position P1.

Figure 10:
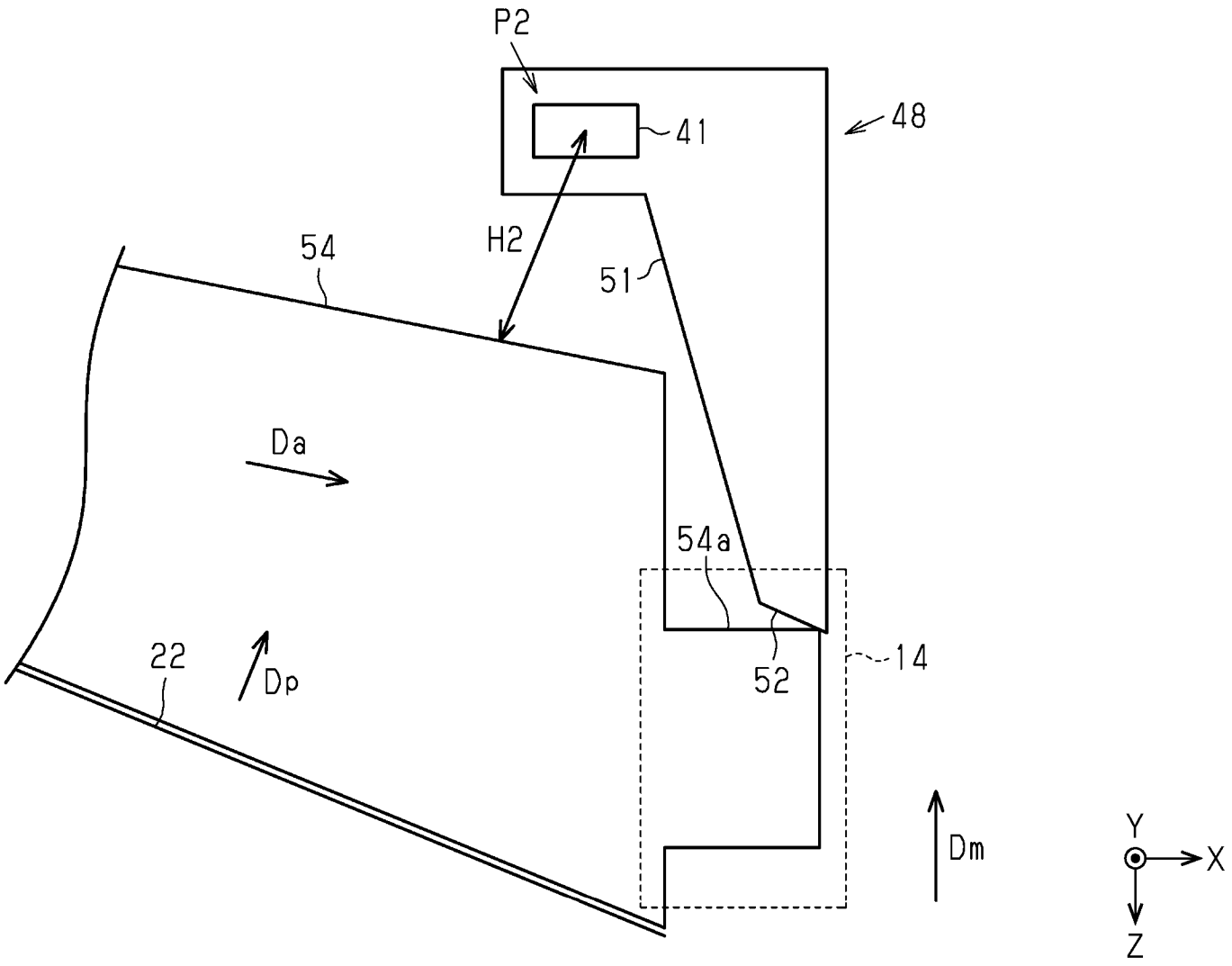
FIG. 10 is a schematic view illustrating the detector in an attached state of the joint mechanism.

As illustrated in FIG. 10, the retaining surface 52 is aligned with the guiding surface 51 in the attaching direction Da and located further than the guiding surface 51 in the attaching direction Da. The retaining surface 52 extends along a plane parallel to the attaching direction Da. Accordingly, when the front edge of the second protrusion 54*a* passes over the guiding surface 51, the joint mechanism 54 moves in the attaching direction Da while retaining the height of the holding member 48. At this time, the detector 41 is retained at the second position P2.

The detector 41 is held by the holding member 48 and moves together with the holding member 48. That is, the detector 41 moves from the first position P1 to the second position P2 in accordance with the joint mechanism 54 being attached to the attachment section 14. The second position P2 of the present embodiment is a position higher than the first position P1. The detector 41 is located at the second position P2 in the state in which the joint mechanism 54 is attached.

The detector 41 located at the second position P2 detects media 15 with the second loading amount H2, which are loaded on the joint mechanism 54. The second loading amount H2 corresponds to a thickness of the loaded media 15 and is equal to a distance from the joint mechanism 54 to the detector 41 located at the second position P2 in the loading direction Dp.

Operation of the present embodiment will be described.

Non-Attached State

Operation in a state in which the joint mechanism 54 is not attached is the same as that of the first embodiment.

Attaching Process

As illustrated in FIG. 9, when attaching the joint mechanism 54 to the attachment section 14, an operator mounts the joint mechanism 54 on the discharge tray 22 and moves the joint mechanism 54 in the attaching direction Da. The operator moves the joint mechanism 54 in the attaching direction Da so as to insert the second protrusion 54*a* into the attachment section 14.

The second protrusion 54*a* moving in the attaching direction Da pushes the guiding surface 51 in the attaching direction Da. The edge of the guiding surface 51 on the downstream in the attaching direction Da is located lower than the edge on the upstream. Accordingly, when the joint mechanism 54 is caused to move in the attaching direction Da, the holding member 48 moves upward, and the detector 41 also moves upward in accordance with the movement of the holding member 48. That is, the holding member 48 and the detector 41 move from the first position P1 to the second position P2 in accordance with the joint mechanism 54 being attached to the attachment section 14. The amount by which the detector 41 moves in the vertical direction Z is proportional to the amount by which the second protrusion 54*a* moves while being in contact with the guiding surface 51.

As illustrated in FIG. 10, when passing over the guiding surface 51, the second protrusion 54*a* comes into contact with the retaining surface 52. The retaining surface 52 extends along a plane parallel to the attaching direction Da. Accordingly, the second protrusion 54*a* moves in the attaching direction Da while retaining the height position of the holding member 48. The second protrusion 54*a* supports the holding member 48 in a push-up state. Attaching the joint mechanism 54 to the attachment section 14 is thereby finished.

Attached State

As illustrated in FIG. 10, the detector 41 is located at the second position P2 in the state in which the joint mechanism 54 is attached. In the attached state of the joint mechanism 54, the medium 15 discharged from the first discharge port 25 is transported to the post-processing device via the joint mechanism 54. In the attached state of the joint mechanism 54, the medium 15 discharged from the second discharge port 26 is loaded on the joint mechanism 54.

When the detector 41 located at the second position P2 detects media 15, the control section 35 determines that the state is a full-load state in which the media 15 with the second loading amount H2 are loaded on the joint mechanism 54. When determining that the state is the full-load state, the control section 35 performs full-load processing. The full-load processing here indicates processing of stopping discharging a medium 15 from the second discharge port 26.

Detaching Process

As illustrated in FIG. 9, the operator detaches the joint mechanism 54 from the attachment section 14 by moving the joint mechanism 54 in a direction opposite to the attaching direction Da. When the second protrusion 54*a* leaves the retaining surface 52, the holding member 48 moves downward due to the weight of the holding member 48. The detector 41 moves downward from the second position P2 together with the holding member 48. The detector 41 may move downward in accordance with the joint mechanism 54 being detached from the attachment section 14.

An effect of the present embodiment will be described.

In an instance in which, for example, the medium 15 is discharged onto the joint mechanism 54, the medium 15 is loaded on the joint mechanism 54. The joint mechanism 54 causes the detector 41 located at the first position P1 to move to the second position P2 higher than the first position P1. Accordingly, even when the medium 15 is loaded on the joint mechanism 54 attached on the discharge tray 22, the detector 41 is able to detect the medium 15.

Each of the aforementioned embodiments is able to be modified and implemented in the following manner. The aforementioned embodiments and the following modified examples may be implemented in combination within a range in which they do not technically contradict each other.

In the first embodiment, at a time of attaching the sub-tray 13, the discharge tray 22 may be detached so as to be moved to a position lower than the position of the discharge tray 22 in the state in which the sub-tray 13 is not attached. The sub-tray 13 may be attached to a place in which the discharge tray 22 is located in the state in which the sub-tray 13 is not attached. In this modified example, in the state in which the sub-tray 13 is attached to the attachment section 14, the discharge tray 22 is located under the sub-tray 13. In this modified example, the detector 41 is located at the second position P2 in the state in which the sub-tray 13 is attached. The detector 41 located at the second position P2 detects media 15 with the second loading amount H2, which are loaded on the discharge tray 22, in the state in which the sub-tray 13 is attached. Also in this modified example, in the state in which the sub-tray 13 is not attached, the detector 41 is located at the first position P1. The second position P2 is a position lower than the first position P1.

In the second embodiment, the joint mechanism 54 may be attached apart from the discharge tray 22. The discharge tray 22 may be detached when the joint mechanism 54 is attached. The joint mechanism 54 may be attached at a position at which the discharge tray 22 is located in the state in which the joint mechanism 54 is not attached.

In the first embodiment, the second distance L2 between the second position P2 and the loading surface 37 in the vertical direction Z may be equal to or more than the minimum distance Ls between the sub-tray 13 attached to the attachment section 14 and the loading surface 37 in the direction perpendicular to the loading surface 37.

In the first embodiment, the amount by which the detector 41 moves from the first position P1 to the second position P2 may be equal to or more than the difference between the first maximum loading amount in the state in which the sub-tray 13 is not attached to the attachment section 14 and the second maximum loading amount in the state in which the sub-tray 13 is attached.

The detector 41 may be a lever sensor that comes into contact with a loaded medium 15 and thereby detects the position of the uppermost medium 15. The detector 41 may be a distance sensor that detects a distance to the uppermost medium 15 among loaded media 15. The detector 41 may be an image sensor that detects a thickness of piled media 15. The detector 41 may be a weight sensor that weighs loaded medium 15.

The configuration of the detector 41 is not limited to being used only for detecting full load of media 15. For example, by detecting a position of an upper surface of a medium 15 before media 15 are fully loaded, a state of the discharge tray 22 in the middle of a printing job may be grasped. Moreover, the configuration may be such that a position of an upper surface of a medium 15 is always monitored.

The moving direction Dm may include a horizontal direction component. The discharge tray 22 has the inclined surface 38 inclined with respect to the horizontal surface. For example, the detector 41 located at the first position P1 may reach the second position P2 by moving in the horizontal direction so as to approach the discharge tray 22.

In the first embodiment, a joint mechanism that joins the printing apparatus and a post-processing device may be used as an optional device. At this time, the joint mechanism 54 may be coupled to the second discharge port 26. When the joint mechanism 54 is being coupled to the second discharge port 26, the detector 41 may move from the first position P1 to the second position P2 located lower than the first position P1.

The optional device may be a post-processing device that performs post-processing for the medium 15 subjected to recording. The optional device may be an inverting mechanism for performing recording on both sides of the medium 15.

The full-load processing is not limited to processing of stopping discharging a medium 15 from the first discharge port 25 or the second discharge port 26 and may be processing of stopping recording performed by the recording section 21, processing of changing a discharging destination of the medium 15 to the optional device, processing of causing a reporting section to report the full-load state, or processing of discharging the medium 15 onto a tray different from the discharge tray 22 or onto the post-processing device.

The printing apparatus 12 may be a printing apparatus that discharges or ejects liquid other than ink. The liquid to be ejected as droplets of a minute amount from the printing apparatus may be in, for example, a granular state, a teardrop state, or a tailing thread-like state. Any material is applicable to the liquid here as long as the material is able to be ejected from the printing apparatus. For example, any liquid is applicable as long as a substance thereof is in a liquid phase, and examples of the liquid include a liquid material having high or low viscosity and a fluid such as a sol, gel water, other inorganic solvents, an organic solvent, a solution, a liquid resin, liquid metal, or metal melt. The liquid includes not only a liquid as one state of a substance but also one in which particles of a functional material formed of a solid substance such as a pigment or metal particles are dissolved, dispersed, or mixed in a solvent. Representative examples of the liquid include ink as described in the aforementioned embodiments and liquid crystal. Here, the ink includes general water-based inks and oil-based inks, and various liquid compositions such as gel ink and hot melt ink. Specific examples of the printing apparatus include an apparatus that ejects liquid containing, in a dispersed or dissolved manner, a material, such as an electrode material or a coloring material, which is used for, for example, manufacturing a liquid crystal display, an electroluminescent display, a surface emitting display, or a color filter. The printing apparatus may be an apparatus that ejects a bioorganic substance used for manufacturing biochips, an apparatus that is used as a precision pipette and ejects liquid serving as a sample, a printing apparatus, or a microdispenser, for example. The printing apparatus may be an apparatus that ejects lubricant onto a precision machine such as a watch or a camera with pinpoint accuracy or an apparatus that ejects, onto a substrate, liquid of a transparent resin such as an ultraviolet curing resin to form, for example, a micro hemispherical lens or an optical lens used in an optical communication element or the like. The printing apparatus may be an apparatus that ejects etchant for acid etching, alkaline etching, or the like to etch a substrate or the like.

Technical ideas and effects obtained from the above-described embodiments and modified examples will be described below.

A printing apparatus includes: a recording section that performs recording on a medium; a discharge tray on which the medium subjected to recording by the recording section is loaded; a detector configured to detect the medium loaded on the discharge tray; and an attachment section to which an optional device is attached, in which the detector is located at a first position in a state in which the optional device is not attached, and the detector moves from the first position to a second position in accordance with the optional device being attached to the attachment section when the optional device is being attached.

According to the configuration, the detector moves from the first position to the second position in accordance with attachment of the optional device. The first position is a position for detecting the medium in the state in which the optional device is not attached. The second position is a position for detecting the medium in the state in which the optional device is attached. Accordingly, a single detector is able to detect the medium, enabling detection of the medium according to the attached state or non-attached state of the optional device while suppressing an increase in cost.

In the printing apparatus, the second position may be a position lower than the first position, and the detector located at the second position may detect the medium loaded on the discharge tray.

In an instance in which, for example, the optional device is attached above the discharge tray so as to be apart from the discharge tray, the number of media which are able to be loaded on the discharge tray decreases compared with an instance in which the optional device is not attached. According to the configuration, the optional device thus causes the detector located at the first position to move to the second position lower than the first position. That is, the detector approaches the discharge tray and is thereby able to detect the medium also in the state in which the optional device is attached.

In the printing apparatus, the second position may be a position higher than the first position, and the detector located at the second position detects the medium loaded on the optional device.

In an instance in which, for example, the medium is discharged onto the optional device, the medium is loaded on the optional device. According to the configuration, the optional device causes the detector located at the first position to move to the second position higher than the first position. Accordingly, even when the medium is loaded on the optional device attached on the discharge tray, the detector is able to detect the medium.

In the printing apparatus, the discharge tray may include a loading surface on which the medium is loaded, and a distance between the second position and the loading surface in a vertical direction may be shorter than a minimum distance between the optional device attached to the attachment section and the loading surface in a direction perpendicular to the loading surface.

According to the configuration, the distance between the second position and the loading surface in the vertical direction is shorter than the minimum distance between the optional device and the loading surface in the direction perpendicular to the loading surface. The minimum distance between the optional device and the loading surface in the direction perpendicular to the loading surface corresponds to the maximum loading amount by which media are able to be loaded on the discharge tray in the state in which the optional device is attached. Accordingly, the detector is able to detect a medium before media with the maximum loading amount are loaded and no more medium is able to be loaded.

In the printing apparatus, when a maximum loading amount of the discharge tray in the state in which the optional device is not attached to the attachment section is a first maximum loading amount and a maximum loading amount of the discharge tray in a state in which the optional device is attached is a second maximum loading amount, an amount by which the detector moves from the first position to the second position is larger than a difference between the first maximum loading amount and the second maximum loading amount.

According to the configuration, the amount by which the detector moves from the first position to the second position is larger than the difference between the first maximum loading amount in the non-attached state and the second maximum loading amount in the attached state. The difference between the first maximum loading amount and the second maximum loading amount corresponds to a loading amount that decreases due to the attachment of the optional device. That is, since the amount by which the detector moves in response to the attachment of the optional device is larger than the loading amount that decreases due to the attachment of the optional device, it is possible to make the second maximum loading amount larger than a loading amount of media detected by the detector at the second position, enabling a reduction in possible overloading.

A printing system includes: the printing apparatus having the aforementioned configuration; and an optional device attached to the printing apparatus.

According to the configuration, it is possible to exert an effect similar to that of the aforementioned printing apparatus.

What is claimed is:

1. A printing apparatus comprising:

a recording section that performs recording on a medium;

a discharge tray on which the medium subjected to recording by the recording section is loaded;

a detector configured to detect the medium loaded on the discharge tray; and an attachment section to which an optional device is attached, wherein the detector is located at a first position in a state in which the optional device is not attached, and moves from the first position to a second position in accordance with the optional device being attached to the attachment section, and the detector is configured to detect the medium in both the first position and the second position.

2. The printing apparatus according to claim 1, wherein the second position is a position higher than the first position, and the detector located at the second position detects the medium loaded on the optional device.

3. The printing apparatus according to claim 1, wherein the second position is a position lower than the first position, and the detector located at the second position detects the medium loaded on the discharge tray.

4. The printing apparatus according to claim 3, wherein the discharge tray includes a loading surface on which the medium is loaded, and a distance between the second position and the loading surface in a vertical direction is shorter than a minimum distance between the optional device attached to the attachment section and the loading surface in a direction perpendicular to the loading surface.

5. The printing apparatus according to claim 3, wherein when a maximum loading amount of the discharge tray in the state in which the optional device is not attached to the attachment section is a first maximum loading amount and a maximum loading amount of the discharge tray in a state in which the optional device is attached is a second maximum loading amount, an amount by which the detector moves from the first position to the second position is larger than a difference in height in a loading direction between the first maximum loading amount and the second maximum loading amount.

6. The printing apparatus according to claim 1, wherein the detector vertically moves from the first position to the second position.

7. The printing apparatus according to claim 6, wherein a direction in which the detector moves intersects a direction in which the medium is loaded.

8. The printing apparatus according to claim 1, wherein the detector is mounted on a holding member, and the detector is located at the first position in the state in which the optional device is not attached to the attachment section, and moves from the first position to the second position in accordance with the optional device being attached to the attachment section and slidable engagement of the optional device along a first guiding surface to rest on a retaining surface.

9. The printing apparatus according to claim 1, wherein the discharge tray is different from the optional device.

10. A printing system comprising:
the printing apparatus according to claim 1; and
an optional device attached to the printing apparatus.

11. A printing apparatus comprising:
a recording section that performs recording on a medium;
a discharge tray on which the medium subjected to recording by the recording section is loaded;
a detector configured to detect the medium loaded on the discharge tray, the detector being mounted on a holding member; and
an attachment section to which an optional device is attached, wherein
the detector is located at a first position in a state in which the optional device is not attached and a second position with the optional device attached to the attachment section, attachment of the optional device moving from the detector from the first position to the second position and a slidable engagement of the optional device along a first guiding surface to rest on a retaining surface.

12. The printing apparatus according to claim 11, wherein the second position is a position higher than the first position, and
the detector located at the second position detects the medium loaded on the optional device.

13. The printing apparatus according to claim 11, wherein the second position is a position lower than the first position, and
the detector located at the second position detects the medium loaded on the discharge tray.

14. The printing apparatus according to claim 13, wherein the discharge tray includes a loading surface on which the medium is loaded, and
a distance between the second position and the loading surface in a vertical direction is shorter than a minimum distance between the optional device attached to the attachment section and the loading surface in a direction perpendicular to the loading surface.

15. The printing apparatus according to claim 13, wherein when a maximum loading amount of the discharge tray in the state in which the optional device is not attached to the attachment section is a first maximum loading amount and a maximum loading amount of the discharge tray in a state in which the optional device is attached is a second maximum loading amount,
an amount by which the detector moves from the first position to the second position is larger than a difference in height in a loading direction between the first maximum loading amount and the second maximum loading amount.

16. The printing apparatus according to claim 11, wherein the detector vertically slides from the first position to the second position.

17. The printing apparatus according to claim 16, wherein a direction in which the detector slides intersect a direction in which the medium is loaded.

18. The printing apparatus of claim 11, wherein the discharge tray is different from the optional device.

19. A printing system comprising:
the printing apparatus according to claim 11; and
an optional device attached to the printing apparatus.

* * * * *